US007703897B2

(12) United States Patent
Ito

(10) Patent No.: US 7,703,897 B2
(45) Date of Patent: Apr. 27, 2010

(54) VALVE DEVICE, LIQUID SUPPLY APPARATUS, AND LIQUID EJECTION APPARATUS

(75) Inventor: Hiroyuki Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 764 days.

(21) Appl. No.: 11/546,281

(22) Filed: Oct. 12, 2006

(65) Prior Publication Data

US 2007/0081056 A1 Apr. 12, 2007

(30) Foreign Application Priority Data

Oct. 12, 2005 (JP) ..... 2005-298025
Sep. 12, 2006 (JP) ..... 2006-247194

(51) Int. Cl.
*B41J 2/175* (2006.01)

(52) U.S. Cl. ..... 347/85

(58) Field of Classification Search ..... None
See application file for complete search history.

(56) References Cited

U.S. PATENT DOCUMENTS 2,522,984 A * 9/1950 Boisseau et al. ..... 361/61
5,697,410 A * 12/1997 Rutter et al. ..... 141/346
6,378,556 B1 * 4/2002 Fondse ..... 137/625.48
6,588,466 B1 * 7/2003 Lohr ..... 141/362

FOREIGN PATENT DOCUMENTS

| | | | |
|---|---|---|---|
| JP | 2001-199080 | A | 7/2001 |
| JP | 2001-212975 | A | 8/2001 |
| JP | 2004-216607 | A | 8/2004 |
| JP | 2004-216608 | A | 8/2004 |
| JP | 2005-53212 | A | 3/2005 |

* cited by examiner

*Primary Examiner*—Stephen D Meier
*Assistant Examiner*—Alexander C Witkowski
(74) *Attorney, Agent, or Firm*—Sughrue Mion, PLLC

(57) ABSTRACT

A valve device for opening and closing a valve including a movable valve member, the valve device comprising: an operation member movable toward and away from the valve, the operation member moving the valve member with magnetic force when moving toward or away from the valve to open or close the valve, wherein the operation member is formed to move in a predetermined direction including a first component representing magnitude of a vector in a movement direction of the valve member and a second component representing magnitude of a vector in a direction perpendicular to the movement direction of the valve member, with the first component being greater than the second component.

7 Claims, 10 Drawing Sheets

VALVE DEVICE, LIQUID SUPPLY APPARATUS, AND LIQUID EJECTION APPARATUS

BACKGROUND

1. Technical Field

The present invention relates to a valve device for opening and closing valves incorporated in a connected part co which a liquid containing member such as an ink cartridge is connected, and to a liquid supply apparatus and a liquid ejection apparatus using the valve device.

2. Related Art

An inkjet recording apparatus is widely known as one type of liquid ejection apparatus. An ink cartridge, functioning as a liquid containing member, is set in the inkjet recording apparatus. In the inkjet recording apparatus, the ink cartridge supplies ink, functioning as a liquid, to a recording head, functioning as a liquid ejector.

An inkjet recording apparatus may have an ink cartridge set on a carriage, which includes a recording head, or in a printer main body. A recording apparatus having an ink cartridge set on the carriage is referred to as an on-carriage recording apparatus. A recording apparatus having an ink cartridge set in the printer main body is referred to as an off-carriage recording apparatus. For example, an off-carriage recording apparatus includes a cartridge holder, which functions as a connected part, in a cartridge accommodation opening for accommodating a cartridge. The holder has supply needles projecting from a surface to which the ink cartridge is to be connected. The supply needles are inserted into ink supply holes of the ink cartridge so as to connect the ink cartridge to the cartridge holder.

Ink remaining in an ink passage formed in the cartridge holder may leak from the holes of the supply needles when the ink cartridge is disconnected. To prevent such ink leakage, valves are arranged on the ink passage in the cartridge holder.

JP-A-2005-53212 describes a valve device for opening and closing valves in cooperation with the attachment and detachment (connection and disconnection) of an ink cartridge. This valve device includes a valve mechanism and a valve lever operably connected to the valve mechanism. When the ink cartridge is disconnected, the valve lever is located at a position at which the urging force of a spring closes valves. When the ink cartridge is connected, the ink cartridge pushes and pivots the valve lever so as to open the valves. This valve device uses a swing-type valve mechanism. More specifically, the valve mechanism includes a swing member having magnets, the quantity of which is in accordance with the number of valves provided in correspondence with the ink colors. The valve mechanism moves its swing member in a direction parallel to a surface of a valve arrangement unit of the cartridge holder. The swing-type valve mechanism is also operable by the power of an electric motor. When ink supply is unnecessary, such as when printing is not being performed, the valves are closed. This prevents ink leakage in case the user removes the ink cartridge after activating the recording apparatus.

FIG. 1 shows a swing member 124 included in a typical swing-type valve mechanism. The swing member 124 has a plurality of magnets 123. As shown in the FIG. 1, the swing member 124 of the swing-type valve mechanism is pivoted in a direction parallel to the surface of a valve arrangement unit 121 in a cartridge holder (in the direction of the arrow in the drawing). A plurality of valves 120 are arranged in the surface of valve arrangement unit 121 (surface parallel to the plane of the drawing). The swing member 124 has the magnets 123 arranged at positions corresponding to valve members 122, which are made of, for example, steel, of the valves 120. The magnets 123 attract the valve members 122. As shown in FIG. 2, the plurality of (six for example) magnets 123 corresponding to the valves 120 are arranged on a back yoke 125, which is a single flat plate. The back yoke 125 is fixed to a holder 124*a*, which is arranged on a distal portion of the swing member 124, in a manner that the magnets 123 face the corresponding valves 120.

The swing member 124 pivots about an axis when its inclined surface is pressed by a lever, which is driven by the power of an electric motor. The swing member 124 pivots to open and close the valves 120. More specifically, when the swing member 124 is arranged at a valve closing position indicated by a double-dashed line in FIG. 1, the magnets 123 are separated from the valve members 122. In this state, the valve members 122 are not attracted to the magnets 123 and the valves 120 are closed. When the swing member 124 rotates to a valve opening position at which the magnets 123 face the valve members 122, the valve members 122 are attracted to the magnets 123 thereby opening the valves 120.

In the closed state of the valves 120, each magnet 123 may be positioned between two adjacent valve members 122. In this case, when the interval between the valve members 122 is narrow, each magnet 123 may attract the adjacent valve members 122. This limitation has made it difficult to further downsize the valve arrangement unit 121 in which the valves 120 are arranged.

Further, the magnets 123 are arranged on the back yoke 125, which is a single large flat-plate. Thus, the magnetic force produced by the magnets 123 is not concentrated at the front of the swing member 124 and is dispersed in the lateral direction of the swing member 124. The diffused magnetic force is neither strengthened when the magnets 123 are moved toward the valve members 122 nor weakened when the magnets 123 are moved away from the valve members 122. Thus, the magnets 123 must be moved by a large amount. This requirement has made it difficult to downsize the valve device. To move the magnets 123 by a large amount, the distance from the pivot axis must be increased by elongating an arm 124*b* of the swing member 124 or the range of the pivot angle (swing angle) of the swing member 124 must be increased. This requirement has made it difficult to downsize the valve device in its height direction or its lateral direction.

SUMMARY

The present invention provides a compact valve device that opens and closes a plurality of valves, a liquid supply apparatus, and a liquid ejection apparatus.

One aspect of the present invention is a valve device for opening and closing a valve including a movable valve member. The valve device includes an operation member movable toward and away from the valve. The operation member moves the valve member with magnetic force when moving toward or away from the valve to open or close the valve. The operation member is formed to move in a predetermined direction including a first component representing magnitude of a vector in a movement direction of the valve member and a second component representing magnitude of a vector in a direction perpendicular to the movement direction of the valve member. The first component is greater than the second component.

Another aspect of the present invention is a liquid supply apparatus for use with a liquid. The liquid supply apparatus includes a connected part to which a liquid containing member is connected. A valve device, arranged on the connected part, opens and closes a valve including a movable valve member. The valve device includes an operation member movable toward and away from the valve. The operation member moves the valve member with magnetic force when moving toward or away from the valve to open or close the valve. The operation member is formed to move in a predetermined direction including a first component representing magnitude of a vector in a movement direction of the valve member and a second component representing magnitude of a vector in a direction perpendicular to the movement direction of the valve member. The first component is greater than the second component.

A further aspect of the present invention is a liquid ejection apparatus for use with a liquid. The liquid supply apparatus includes an accommodation portion for accommodating a liquid containing member and a connected part to which the liquid containing member is connected. The connected part is arranged in the accommodation portion. A valve device, arranged on the connected part, opens and closes a valve including a movable valve member. A liquid ejection head ejects liquid supplied from the liquid containing member via the connected part. The valve device includes an operation member movable toward and away from the valve. The operation member moves the valve member with magnetic force when moving toward or away from the valve to open or close the valve. The operation member is formed to move in a predetermined direction including a first component representing magnitude of a vector in a movement direction of the valve member and a second component representing magnitude of a vector in a direction perpendicular to the movement direction of the valve member. The first component is greater than the second component.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

Figure 1:
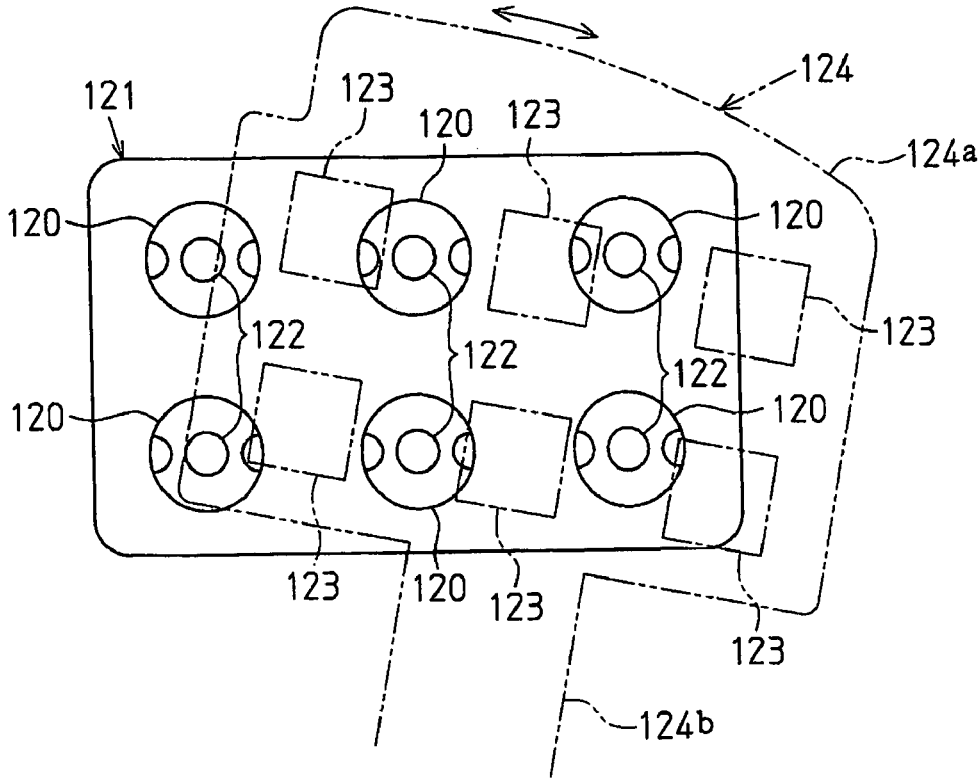
Fig. 1(Prior Art)
FIG. 1 is a schematic front view of a swing member included in a valve mechanism of the related art.
Figure 2:
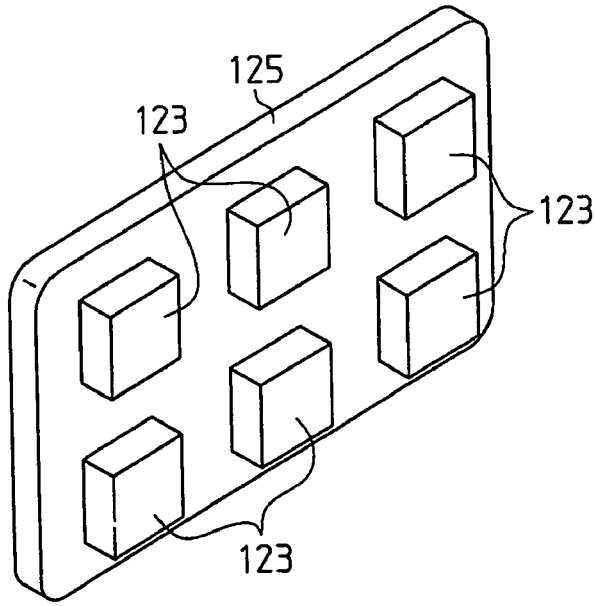
Fig. 2(Prior Art)
FIG. 2 is a schematic perspective view showing magnets and a yoke shown in FIG. 1.

In the drawings, like numerals are used for like elements throughout.

A preferred embodiment of the present invention will now be described with reference to FIGS. 3 to 16.

Figure 3:
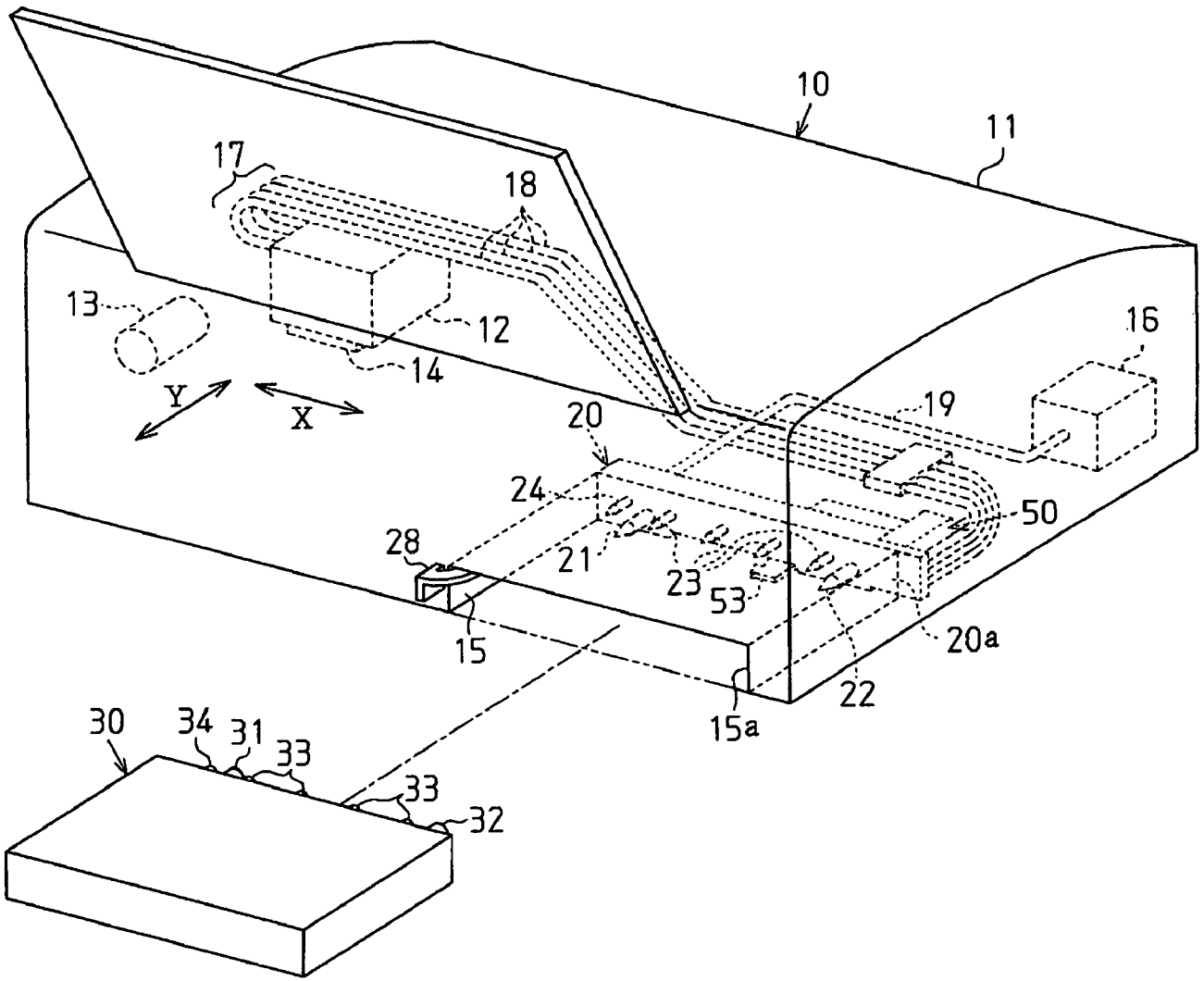
FIG. 3 is a schematic perspective rear view of an inkjet printer according to a preferred embodiment of the present invention.
Figure 4:
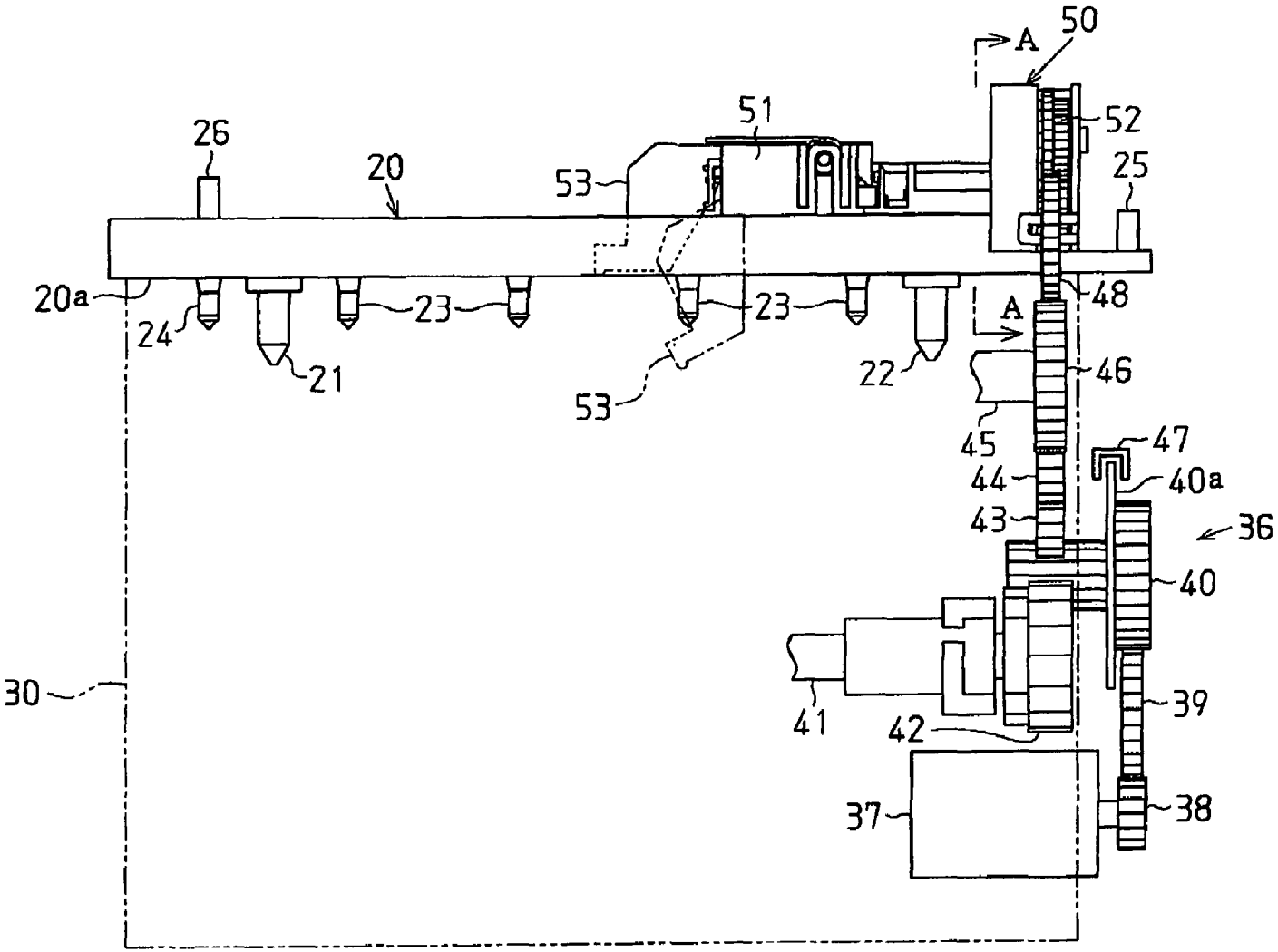
FIG. 4 is a schematic plan view showing a drive system for a valve device shown in FIG. 3.

FIG. 3 is a schematic perspective rear view of an inkjet recording apparatus (hereafter referred to as "printer 10") according to a preferred embodiment of the present invention. FIG. 4 is a schematic front view showing a valve device 50 that is arranged on an ink cartridge holder 20 shown in FIG. 3.

As shown in FIG. 3, the printer 10, which functions as a liquid ejection apparatus or a liquid supply apparatus, includes a main body case 11, which is generally box-shaped. A carriage 12 is arranged in the main body case 11 in a manner movable along a guide rod (not shown) arranged between a pair of side plates. A carriage motor 13 drives and reciprocates the carriage 12 in a main scanning direction X shown in FIG. 1 along the guide rod.

A recording head 14, which functions as a liquid ejection head, is arranged on a lower surface of the carriage 12. The recording head 14 has a plurality of ejection nozzles (not shown) for ejecting ink functioning as a liquid. The carriage 12 further includes a plurality of sub-tanks (not shown) and a plurality of valve units (not shown) for supplying ink to the recording head 14 under adjusted pressures. Four colors of ink (black, yellow, magenta, and cyan) can be supplied to the recording head 14 under adjusted pressures.

A platen (not shown) functioning as a paper feeding mechanism is arranged below an area in which the carriage 12 moves in the main body case 11. The platen extends in a direction parallel to the main scanning direction X. The platen feeds a recording paper functioning as a target in a secondary scanning direction Y, which is perpendicular to the main scanning direction X. Ink droplets are ejected from the ejection nozzles of the recording head 14 onto the recording paper fed in the secondary scanning direction Y so that printing is performed.

The printer 10 of the preferred embodiment is an off-carriage printer in which an ink cartridge is not set on the carriage. A cartridge accommodation portion (hereafter referred to as an "accommodation portion 15") is defined in the main body case 11. A cartridge holder (hereafter referred to as "holder 20"), which serves as a connected part, is arranged in the accommodation portion 15 of the main body case 11. An ink cartridge (hereafter referred to as "cartridge 30"), which serves as a liquid containing member, is inserted through an accommodation opening 15*a* and set onto (connected to) the holder 20. The cartridge 30 is a multicolor cartridge containing ink packs of four colors.

As shown in FIG. 3, a pump 16 (suction pump) is arranged in a front part of the main body case 11. A belt-shaped passage bundle 17, which is formed from an elastic material, connects the holder 20 and the carriage 12. The passage bundle 17 includes four supply passages 18 forming liquid passages. Each supply passage 18 supplies ink from the cartridge 30 connected to the holder 20 to a corresponding sub-tank in the carriage 12. The pump 16 and the holder 20 are connected by a single passage 19. Waste ink is discharged from the pump 16 via the passage 19 to the cartridge 30, which is connected to the holder 20. The pump 16 has an inlet portion that is in communication with a portion storing waste ink. The waste ink is discharged into the cartridge 30 via the passage 19. In this way, the cartridge 30 of the preferred embodiment functions to collect waste liquid.

As shown in FIGS. 3 and 4, the holder 20 is elongated in the lateral direction and is generally rectangular and planar in correspondence with the cartridge 30. The holder 20 has a connection surface 20*a*, which is formed on the side facing toward the accommodation opening 15*a*. The connection surface 20*a* of the holder 20 is connected to the cartridge 30. The connection surface 20*a* of the holder 20 has two positioning projections 21 and 22 arranged near the two ends, a plurality of (four in the present example) ink supply needles (hereafter referred to as "supply needles 23") arranged at substantially uniform intervals between the positioning projections 21 and 22, and an introduction needle 24 arranged close to and outward from the positioning projection 21. Each of the supply needles 23 and the introduction needle 24 has an introduction hole (not shown) formed in its distal end. A plurality of passages 75 (shown in FIG. 16), each of which is in communication with one of the supply needles 23, are formed in the holder 20. Each of the passages 75 is in communication with a separate discharge tube 25 (discharge port) (shown in FIG. 4). Further, each supply passage 18 (tube) in the passage bundle 17 is connected to one of the discharge tubes 25. An introduction tube 26 projects from the holder 20. The passage 19 (tube) is connected to the introduction tube 26.

As shown in FIG. 3, the cartridge 30 is box-shaped and has a closed bottom. The cartridge 30 has on a front surface, which is connected to the holder 20, two positioning support openings 31 and 32 formed at positions corresponding to the two positioning projections 21 and 22. The cartridge 30 further has on the front surface a plurality of ink supply support openings 33 formed at positions corresponding to the supply needles 23 of the holder 20 and a waste ink introduction opening 34 formed at a position corresponding to the introduction needle 24 of the holder 20.

When the cartridge 30 is connected to the holder 20, the positioning projections 21 and 22 are fitted in the corresponding positioning support openings 31 and 32 to restrict movement of the cartridge 30 in a direction perpendicular to the direction in which the cartridge 30 is connected (Y-axis direction in FIG. 3). A circuit board (not shown) is installed in a recess formed in a lower part of the front surface of the cartridge 30. When the cartridge 30 is connected to the holder 20, the circuit board is connected to a terminal unit (not shown) projecting from the contact surface 20*a* of the holder 20. In a state in which the terminal unit is connected to the circuit board, information on ink consumption amount and other information are transmitted between the cartridge 30 and a control unit (not shown) of the printer 10.

Further, as shown in FIG. 3, a lever handle 28 is arranged at one end of the accommodation opening 15*a* of the accommodation portion 15. The lever handle 28 is operated to push the cartridge 30 into the accommodation portion 15 so that the cartridge 30 engages the supply needles 23 etc. of the holder 20 with a relatively small force due to a reducing gear mechanism (not shown). When the cartridge 30 is connected to the holder 20, a lock mechanism (not shown) locks the cartridge 30 at the connected position.

Valves 76 (shown in FIG. 16) are arranged in the passages 75 of the holder 20 to prevent the backflow of ink. As shown in FIG. 4, the valve device 50 for opening and closing the valves 76 is arranged on one end of a rear surface of the holder 20 that is opposite to the contact surface 20*a* of the holder 20. The valve device 50 includes a power transmission mechanism 52 (first transmission mechanism) arranged on one end (right end in FIG. 4) of a housing 51. The valve device 50 further includes a valve opening lever 53 arranged on the other end (left end in FIG. 4) of the housing 51. The valve opening lever 53 is urged by a return coil spring 58 (urging member) in a direction in which the valve opening lever 53 projects into the accommodation portion 15. In the preferred embodiment, the valve opening lever 53 and the return coil spring 58 function as another power transmission mechanism (second transmission mechanism). When the valve opening lever 53 is pushed by the cartridge 30 against the urging force of the return coil spring 58, the valve device 50 unlocks the valves 76 at the closing position. When the valves 76 are in an unlocked state, the valve device 50 opens and closes the valves 76 in the holder 20 with the power transmitted from an electric motor 37 (rotation drive source) to the power transmission mechanism 52. In the preferred embodiment, the electric motor 37 is a paper feeding motor. The valve device 50 is driven using power produced by the electric motor 37 for driving a paper transporting mechanism 36 (refer to FIG. 4) for setting, feeding, and discharging a recording paper. The paper transporting mechanism 36 will be described later.

As shown in FIG. 4, the paper transporting mechanism 36 is arranged above the accommodation portion 15 in a rear part of the printer 10. The paper transporting mechanism 36 includes a paper setting unit, a paper feeding mechanism, and a paper discharging mechanism. The paper transporting mechanism 36 is driven using the single electric motor 37 as a drive power source. FIG. 4 does not show the paper feeding unit. Rotation of a pinion gear 38 fixed to a drive shaft of the electric motor 37 is transmitted to a two-stage gear 40 via a gear 39 and further transmitted to a gear 42, which is fixed to a distal portion of a paper feed roller shaft 41. As a result, the paper feed roller shaft 41 rotates. Further, rotation of the two-stage gear 40 is transmitted to a gear 46, which is fixed to a distal portion of a paper discharge roller shaft 45, via two gears 43 and 44. As a result, the gear 46 rotates, and the paper discharge roller shaft 45 rotates. A slit circular plate 40*a* for an encoder is fixed to the two-stage gear 40. A sensor 47 detects the number of intermittent light passing through a slit of the slit circular plate 40*a* to generate a pulse signal. Based on a pulse signal provided from the sensor 47, the control unit (not shown) of the printer 10 calculates the paper feed amount of the recording paper.

The gear 46 is operably connected to the power transmission mechanism 52, which is arranged at one end (right end in FIG. 4) of the housing 51 of the valve device 50 via a gear 48. When power is transmitted from the electric motor 37 to the power transmission mechanism 52, the valve device 50 is driven. In the preferred embodiment, the electric motor 37 is driven in the same rotation direction as when paper setting, paper feeding, or paper discharging is performed and when the valve device 50 opens the valves 76. When the valve device 50 closes the valves 76, the electric motor 37 is driven in a rotation direction reverse to the rotation direction for paper setting, paper feeding, or paper discharging.

(Valve Device 50)

The structure of the valve device 50 will now be described in detail.

Figure 5:
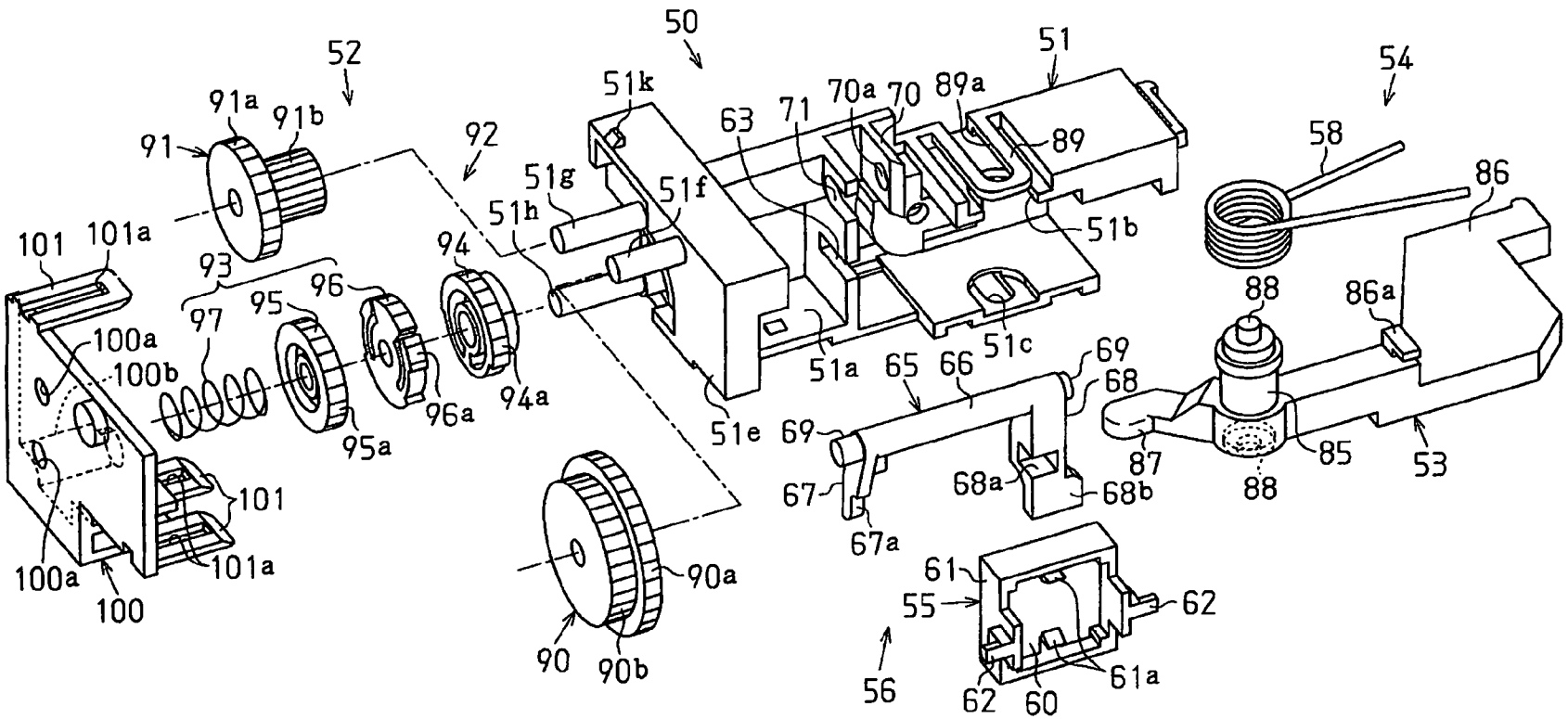
FIG. 5 is a schematic exploded perspective view of the valve device shown in FIG. 3.
Figure 6:
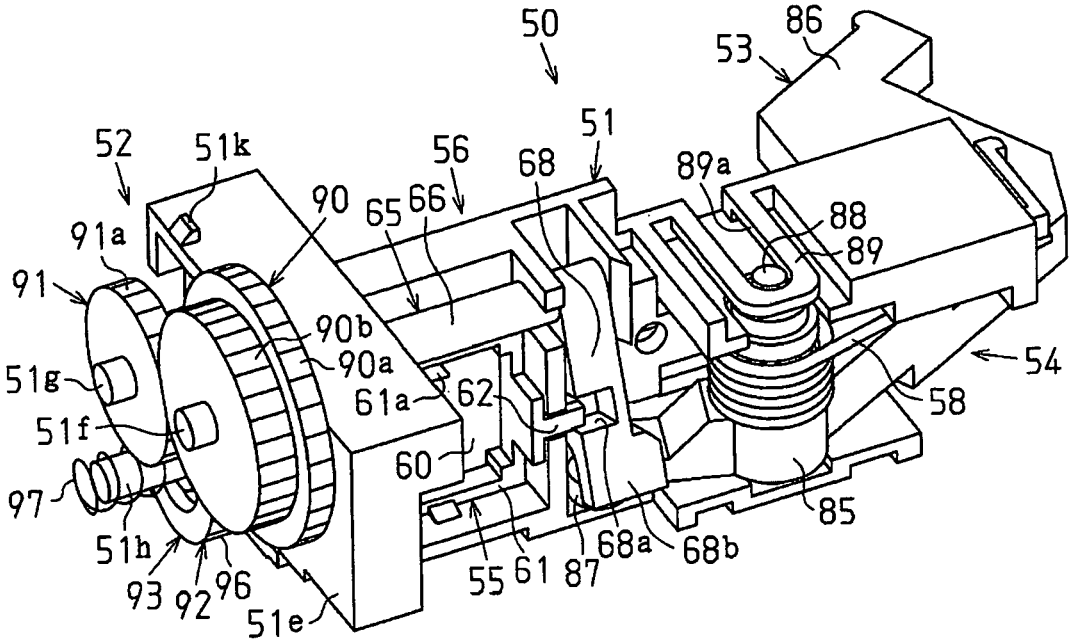
FIG. 6 is a schematic perspective view of the valve device shown in FIG. 3.
Figure 7:
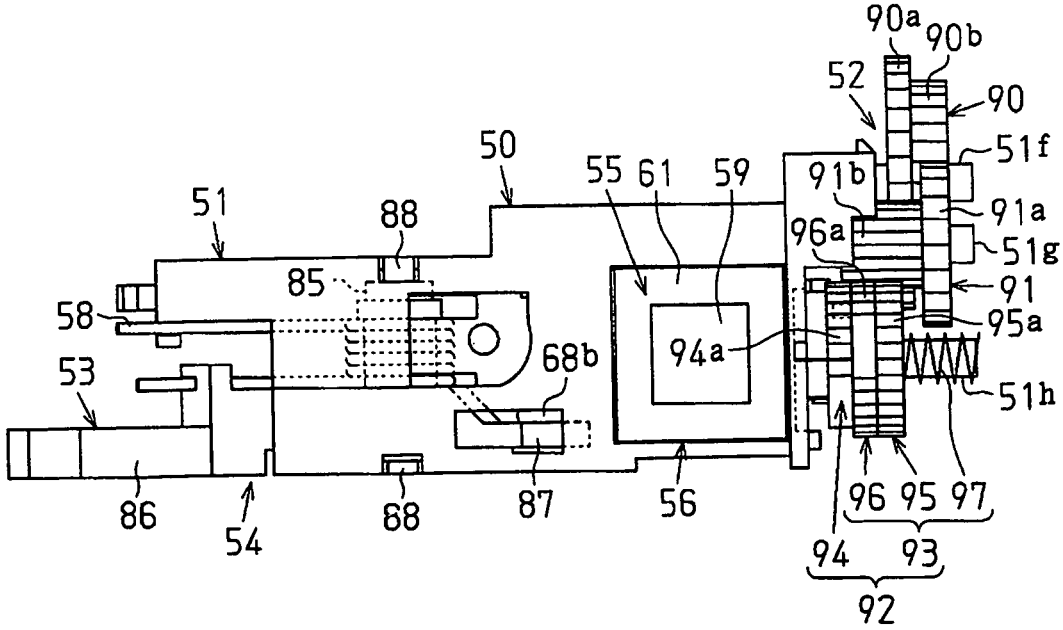
FIG. 7 is a schematic front view of the valve device shown in FIG. 3.
Figure 8:
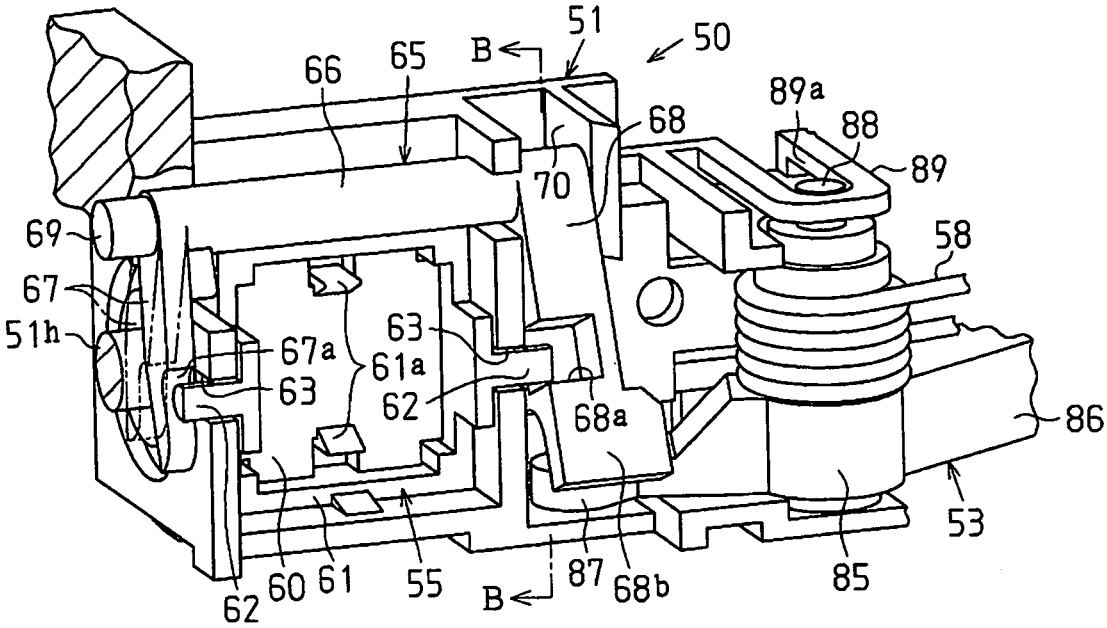
FIG. 8 is a schematic partial perspective view of the valve device shown in FIG. 3.
Figure 9:
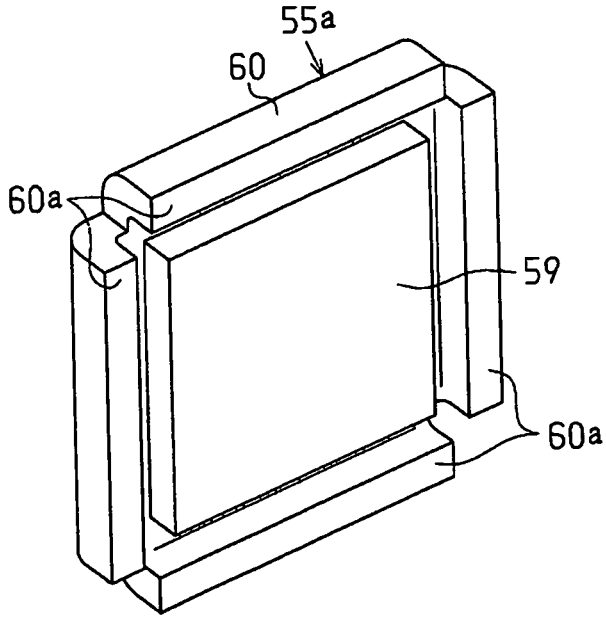
FIG. 9 is a schematic perspective view of a main body of a magnetic member shown in FIG. 5.

FIG. 5 is an exploded perspective view of the valve device 50 shown in FIGS. 3 and 4. FIG. 6 is a perspective view of the valve device 50. FIG. 7 is a front view of the valve device 50. FIG. 8 is a perspective view showing an essential part of a moving mechanism 56 for moving a magnetic member 55 of the valve device 50. FIG. 9 is a perspective view of a main body of the magnetic member 55.

The valve device 50 of the preferred embodiment opens and closes the valves 76 using the magnetic force of a magnet. As shown in FIGS. 5 to 7, the valve device 50 includes a lock mechanism 54, the moving mechanism 56, and the power transmission mechanism 52. The lock mechanism 54 forcibly closes the valves 76 and locks the valves 76 when the cartridge is disconnected. The moving mechanism 56 reciprocates the magnetic member 55 (magnet unit) to open and close the valves 76. The power transmission mechanism 52 transmits power to the moving mechanism 56. The lock mechanism 54 includes the valve opening lever 53 and the return coil spring 58 for forcing the valve opening lever 53 in a direction in which the valve opening lever 53 projects into the accommodation portion 15. In the preferred embodiment, the second transmission mechanism (53 and 58), which is the power transmission mechanism, further functions as the lock mechanism 54.

(Moving Mechanism 56)

As shown in FIGS. 5 to 8, the magnetic member 55 includes a magnet 59 (shown in FIG. 7), a back yoke (hereafter referred to as "yoke 60"), and a holder 61. As shown in FIG. 9, the magnet 59, which is formed as a rectangular plate, has a rear surface and side surfaces surrounded by the yoke 60, which is formed by a metal plate made from a ferromagnetic material. In other words, the yoke 60 has its peripheral sides projecting toward the front surface of the magnet 59 (surface facing the valves 76) so as to surround the periphery of the magnet 59. The yoke 60 enables magnetic lines of force (magnetic flux) of the magnet 59 to concentrate at the front surface of the magnetic member 55 so as to increase the magnetic force applied to valve members 81 (refer to FIGS. 11 and 16) forming the valves 76. The valve members 81 are made from a ferromagnetic material (e.g., steel). The yoke 60 further functions to strengthen the magnetic force at positions closer to the magnetic member 55 and weaken the magnetic force at positions distant from the magnetic member 55. The magnet 59 may, for example, be formed by a rare-earth magnet having a relatively strong ferromagnetic force, such as a neodymium magnet or a samarium magnet. Alternatively, the magnet 59 may be formed by a ferrite magnet.

Referring to FIG. 5, the holder 61, which is made of resin, accommodates the yoke 60. Except for the front surface, the yoke 60 entirely envelopes the magnet 59. The holder 61 has an opening accommodating the magnet 59 with the front surface of the magnet 59 exposed from the opening. The holder 61 also has two support arms 62 and 62 extending externally. As shown in FIG. 8, two guide slots 63 is formed in a square accommodation portion 51*a* of the housing 51 to receive the support arms 62 and 62. The two support arms 62 and 62 are inserted into the two guide slots 63. As a result, the magnetic member 55 is guided along the inner wall surface of the accommodation portion 51*a* and is linearly movable (slidable) toward and away from the surface of a portion of the holder 20 in which the valves 76 are arranged. The surface of the portion of the holder 20 in which the valves 76 are arranged is referred to as a magnetic force application surface 78 (refer to FIG. 16) to which the magnetic force is applied. As shown in FIG. 5, the yoke 60 enveloping the magnet 59 is engaged with two tabs 61*a* projecting from the holder 61 so as to fix the yoke 60 to the holder 61.

As shown in FIG. 9, a main body 55*a* of the magnetic member 55 includes the single magnet 59 and the single yoke 60. The yoke 60 has projections 60*a*, which are formed by bending peripheral parts of a flat plate made from a ferromagnetic material in the direction of the front surface of the magnet 59 facing the valve members 81 of the valves 76 (refer to FIG. 16). As a result, the rear surface and the four side surfaces of the magnet 59 are surrounded by the yoke 60 and its projections 60*a*. The yoke 60 having the projections 60*a* projecting toward the front surface of the magnet 59 enables the magnetic force of the magnetic member 55 to concentrate on the front surface. As a result, the magnetic force is strengthened at positions closer to the magnet 59 and weakened at positions distant from the magnet 59 since the magnetic force is applied in the front direction of the magnetic member 55 (in the direction of the valves 76). This shortens the movement stroke of the magnetic member 55 required to open and close the valves 76. The material for the yoke 60 may be, for example, silicon steel, soft iron, permalloy, or stainless steel.

Figure 10A:
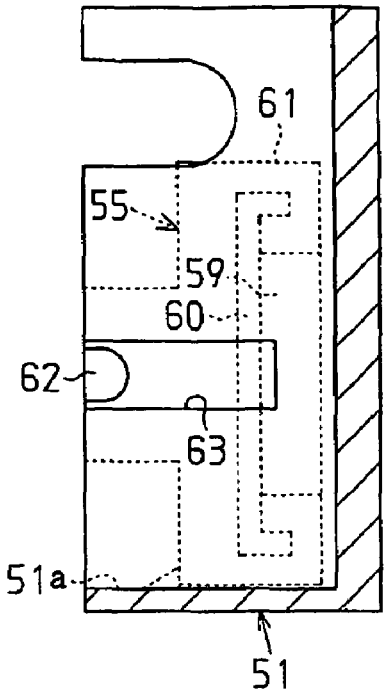
FIG. 10A shows the magnetic member shown FIG. 5 at a closing position and FIG. 10B shows the magnetic member shown FIG. 5 at an opening position.
Figure 10B:
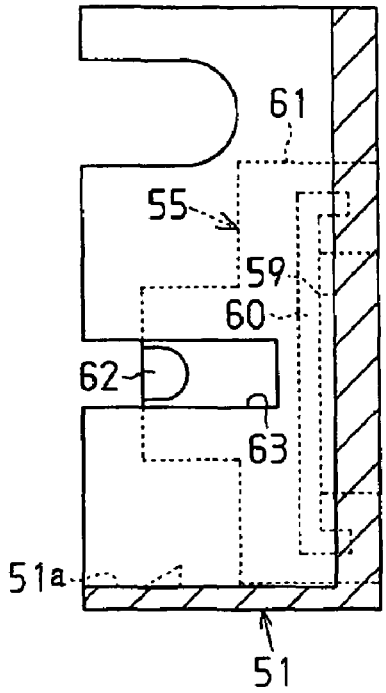

FIG. 10 is a side view of the moving mechanism 56 of the magnetic member 55. FIG. 10A shows the magnetic member 55 at a closing position for closing the valves 76. FIG. 10B shows the magnetic member 55 at an opening position for opening the valves 76. The accommodation portion 51*a* of the housing 51 has a square box with inner wall surfaces of which cross-sectional area in a direction perpendicular to the axial direction of the holder 61 (direction perpendicular to the plane of FIG. 10A) is slightly greater than that of the holder 61 taken in the same direction. The inner wall surfaces of the accommodation portion 51*a* of the housing 51 guides the holder 61 of the magnetic member 55 when the holder 61 moves in the accommodation portion 51*a*. The axial line of the square box forming the inner wall surfaces coincides with the direction perpendicular to the magnetic force application surface 78 (refer to FIG. 16). The two guide slots 63 formed in the side walls of the accommodation portion 51*a* extend in the direction perpendicular to the magnetic force application surface 78 and guide the two support arms 62 of the magnetic member 55 in the direction perpendicular to the magnetic force application surface 78. As a result, the magnetic member 55 has its holder 61 guided by the inner wall surface of the accommodation portion 51*a* and its support arms 62 guided by the guide slots 63 so that the magnetic member 55 moves linearly between the closing position shown in FIG. 10A and the opening position shown in FIG. 10B.

As shown in FIG. 5, a swing lever 65 (pivot member) is pivotally fixed on the housing 51 at a position above and close to the accommodation portion 51*a* for accommodating the magnetic member 55. The swing lever 65 includes a shaft 66 around which the swing lever 65 is pivoted, a first lever support (first engagement portion) 67, and a second lever support (second engagement portion) 68. The first lever support 67 and the second lever support 68 respectively extend from the two ends of the shaft 66 in substantially the same direction (downward in FIG. 5). The first lever support 67 has a recess 67*a* at a position facing one support arm 62 of the holder 61. The second lever support 68 has a recess 68*a* at a position facing the other support arm 62 of the holder 61. The support arms 62 and 62 are received in the recesses 67*a* and 68*a*, respectively.

The shaft 66 of the swing lever 65 has support pins 69 and 69 at its two ends. The support pins 69 and 69 have a smaller diameter than the shaft 66. The support pin 69 at the left end (left side in FIG. 5) of the shaft 66 is supported axially in a support hole (not shown) formed in a side wall of the housing 51. The right end of the shaft 66 is supported axially at two positions at opposite sides of the base of the second lever support 68. More specifically, in a state in which the support pin 69 at the right end of the shaft 66 is inserted into a hole 70*a* of an extension 70 and a portion of the shaft 66 near the right end being received in a support slot 71, the swing lever 65 is supported in a pivotal manner.

When the swing lever 65 is pivoted, the magnetic member 55, of which support arms 62 and 62 are arranged in the recesses 67*a* and 68*a* of the first and second lever supports 67 and 68, moves toward the valves 76 in the direction perpendicular to the magnetic force application surface 78 (refer to FIG. 16) of the holder 20.

Figure 16A:
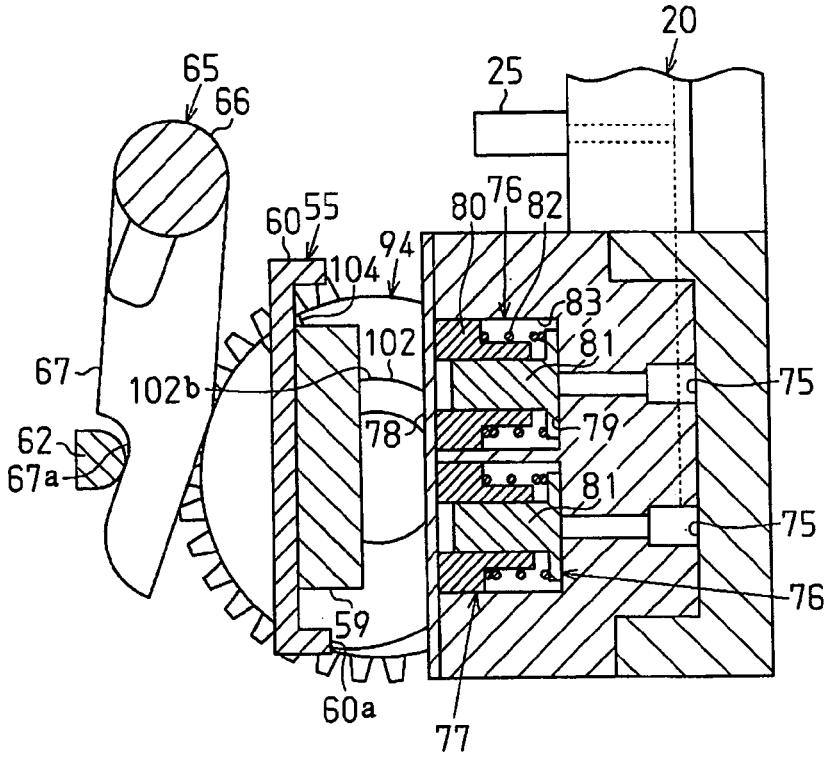
FIG. 16A is a cross-sectional view taken along line A-A in FIG. 4 and showing the magnets at the closing position.
Figure 16B:
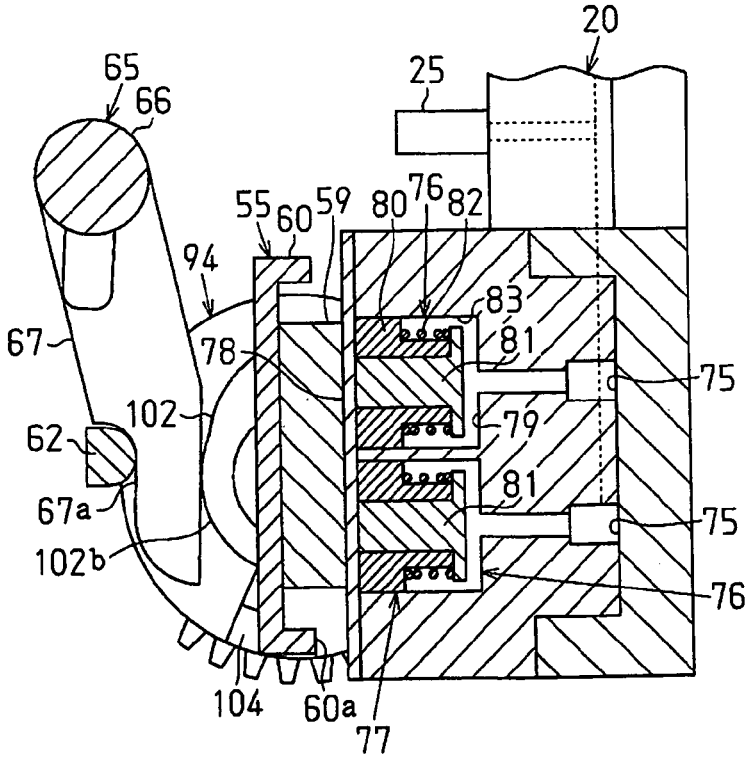
FIG. 16B is a cross-sectional view taken along line A-A in FIG. 4 and showing the magnets at the opening position.

FIG. 16 is a cross-sectional view illustrating the opening and closing operation of the valves 76 using the magnetic member 55. FIG. 16 is a cross-sectional view taken along line A-A in FIG. 4 and is drawn as a perspective view in which part of the housing 51 is removed to show a cylindrical cam 94, which will be described later. The holder 20 has the passages 75, each of which is in communication with a different one of the supply needles 23. One valve 76 is arranged in each passage 75. The passages 75 are in communication with the corresponding discharge tubes 25 (discharge ports) (only one shown) at positions downstream from the valves 76. The plurality of (in this embodiment, four) valves 76 are collectively arranged in parallel in the holder 20 facing towards the magnetic member 55. The valves 76 form a valve arrangement unit 77 of the holder 20. The surface of the valve arrangement unit 77 facing towards the magnetic member 55 is the magnetic force application surface 78. Each valve 76 includes a cylindrical member 80, a valve member 81, and a spring 82. The cylindrical member 80 is accommodated in a valve chamber 79, which is defined in the holder 20. The valve member 81 is inserted into the cylindrical member 80 in a slidable manner. The spring 82 forces the valve member 81 in a valve-closing direction (right direction as viewed in the drawing). When the magnetic member 55 of the valves 76 is distanced from the magnetic force application surface 78 as shown in FIG. 16A, the urging force of the spring 82 causes the valve members 81 to come in contact with valve seats 83 and close the valves 76. When the magnetic member 55 is close to a position where it substantially comes into contact with the magnetic force application surface 78 as shown in FIG. 16B, the magnetic force of the magnetic member 55 attracts the valve members 81 and opens the valves 76. A mechanism for moving the magnetic member 55 will be described later.

Referring to FIG. 6, the second lever support 68 of the swing lever 65 has a distal portion defining a square abutment portion 68*b*. A functional arm 87 of the valve opening lever 53 comes in contact with the abutment portion 68*b*.

As shown in FIG. 6, the housing 51 supports the end of the valve opening lever 53 located closest to the swing lever 65 (right end in the drawing) in a pivotal manner. The valve opening lever 53 includes a rod 85, a lever portion 86, and the functional arm 87. The lever portion 86 extends from the rod 85. The functional arm 87 extends from the rod 85 at the opposite side of the lever portion 86. The valve opening lever 53 has support pins 88 and 88 at two ends of the rod 85. As shown in FIG. 5, one of the support pins 88 (upper one in FIG. 5) is inserted into and supported by an elongated hole 89*a* in an extension 89 extending from the upper wall of the housing 51. An upper portion of the rod 85 is inserted into and supported by a slot 51*b* formed on the upper wall of the housing 51. The other one of the support pins 88 is inserted into a support hole 51*c* formed in the lower wall of the housing 51. As a result, the rod 85 extends in the vertical direction in a manner that the axis of the rod 85 is perpendicular to the axis of the shaft 66 of the swing lever 65. The rod 85 is pivotally connected to the housing 51. The lever portion 86 comes in contact with the front surface of the cartridge 30 when the cartridge 30 is connected. The valve opening lever 53 pivots when the cartridge 30 pushes the lever portion 86. The return coil spring 58 set around the rod 85 is fixed to the valve opening lever 53. The return coil spring 58 has one end engaged with a spring reception unit 86*a*, which projects from on the upper surface of the lever portion 86, and another end engaged with a spring reception unit 51*d* (refer to FIG. 12) projecting from the lower surface of the upper wall of the housing 51. As a result, the valve opening lever 53 is pressed to pivot the lever portion 86 in the direction in which the lever portion 86 projects into the accommodation portion 15. The valve opening lever 53 is pivoted by the return coil spring 58 and comes in contact with the distal portion of the housing 51 so that its movement is restricted by the distal portion of the housing 51. As a result, the valve opening lever 53 is arranged to project into the accommodation portion 15. The arrangement angle of the lever portion 86 at this extended position is set in a manner that the lever portion 86 pivots in a direction opposite to the urging direction of the return coil spring 58 when the lever portion 86 is pushed in the direction in which the cartridge is connected.

The functional arm 87 of the valve opening lever 53 has a length large enough to come in contact with the rear surface of the abutment portion 68*b* of the second lever support 68. The distal portion of the functional arm 87 is bent in a manner that the functional arm 87 pushes the rear surface of the abutment portion 68*b* in the second lever support 68 in a substantially linear manner when the valve opening lever 53 pivots.

Figure 12A:
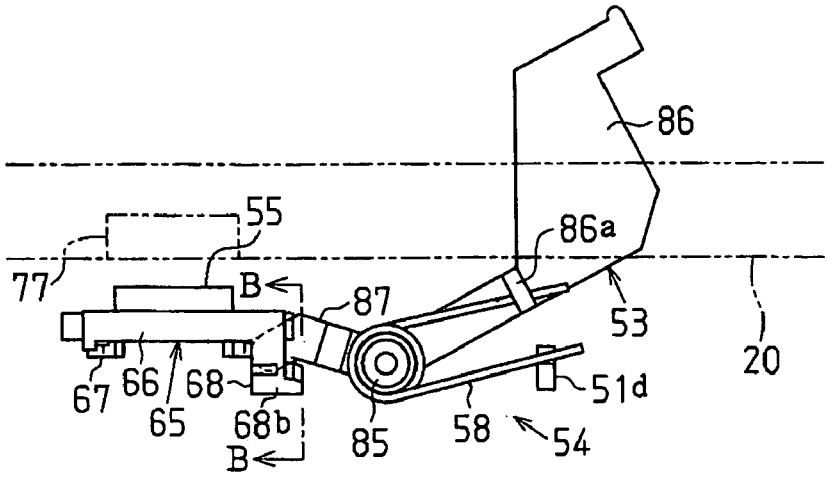
FIG. 12A is a schematic plan view of a lock mechanism shown in FIG. 5 in a state disconnected from a cartridge.
Figure 12B:
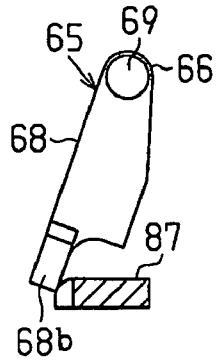
FIG. 12B is a cross-sectional view taken along line B-B in FIG. 12A.

FIGS. 12 and 13 show the lock mechanism 54. FIG. 12 shows the state in which the valve opening lever 53 of the lock mechanism 54 is located at a projected position when the cartridge is disconnected. FIG. 13 shows the state in which the valve opening lever 53 is at a retracted position when the cartridge is connected. The direction from the top to the bottom of FIGS. 12 and 13 is the direction in which the cartridge is connected. As shown in FIGS. 12A and 12B, the lever portion 86 of the valve opening lever 53 projects from the holder 20 into the accommodation portion 15 when the cartridge is disconnected. This projected position of the valve opening lever 53 corresponds to a locked position of the valve opening lever 53. In the locked state of the valve opening lever 53, the distal portion of the functional arm 87 pushes the rear surface of the abutment portion 68*b* of the second lever support 68, and the magnetic member 55 is arranged at the retracted position (position shown in FIG. 16A) distanced from the magnetic force application surface 78 of the holder 20.

Figure 13A:
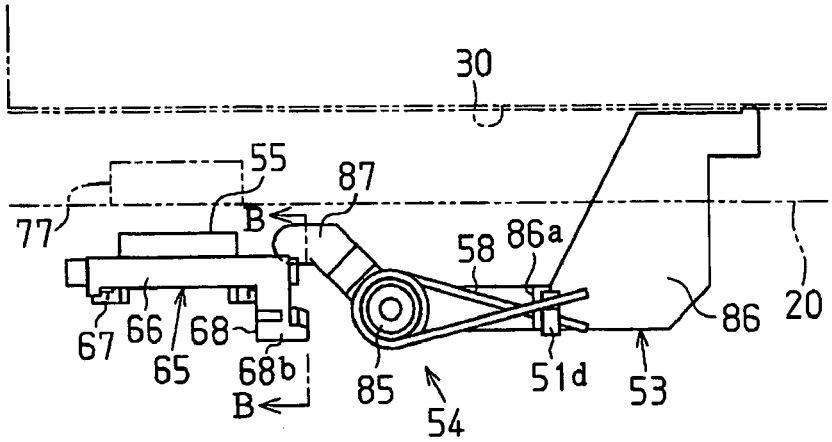
FIG. 13A is a schematic front view of the lock mechanism shown in FIG. 5 in a state connected to the cartridge.
Figure 13B:
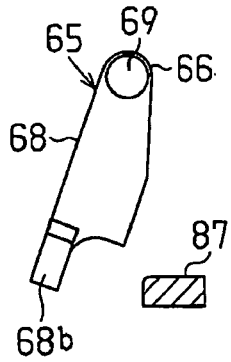
FIG. 13B is a cross-sectional view taken along line B-B in FIG. 13A.

As shown in FIGS. 13A and 13B, the valve opening lever 53 is pushed in by the cartridge 30 and pivoted clockwise and away from the locked position shown in FIG. 12 when the cartridge is connected. The distal portion of the functional arm 87 is moved away from the abutment portion 68*b* of the second lever support 68 by a predetermined distance and retracted. The retracted position of the valve opening lever 53 corresponds to an unlocked position of the valve opening lever 53. In the unlocked state of the valve opening lever 53, when the first lever support 67, which will be described later, is unlocked, the swing lever 65 becomes pivotal. In the preferred embodiment, pivoting of the valve opening lever 53 between the first position (unlocked position shown in FIG. 13A) and the second position (locked position shown in FIG. 12A) corresponds to a second output movement of the second transmission mechanism.

As shown in FIGS. 5 to 7, the power transmission mechanism 52 (first transmission mechanism) for receiving power from the electric motor 37 is arranged at a position opposite to the valve opening lever 53 with respect to the swing lever 65. The first transmission mechanism, which is the power transmission mechanism 52, transmits power from the electric motor 37 to the first lever support 67 to pivot the swing lever 65.

The first transmission mechanism, which is the power transmission mechanism 52, includes a two-stage gear 90 as an input gear for receiving power from the electric motor 37, a two-stage gear 91 that is engaged with a small-diameter gear portion 90*b* of the two-stage gear 90, and a clutch cam mechanism 92 that is engaged with a small-diameter gear portion 91*b* of the two-stage gear 91. In the preferred embodiment, interrelated operations of the two-stage gears 90 and 91 and the clutch cam mechanism 92 correspond to the first output movement. The clutch cam mechanism 92 includes a friction clutch gear mechanism 93 and a cylindrical cam 94 functioning as a cam member. The friction clutch gear mechanism 93 includes a gear 95, a cylinder 96, and a coil spring 97. The cylinder 96 and the gear 95 are coaxial and rotatable relative to each other. The coil spring 97 urges the gear 95 against the cylinder 96. The cylindrical cam 94 and the cylinder 96 are coaxial and rotatable relative to each other.

Three shafts 51*f*, 51*g*, and 51*h* project from a side wall 51*e* of the housing 51. The two-stage gear 90 is set on the shaft 51*f*. The two-stage gear 91 is set on the shaft 51*g*. The cylindrical cam 94, the cylinder 96, the gear 95, and the coil spring 97 are set on the shaft 51*h* (refer to FIGS. 6 and 7).

The cylinder 96 of the friction clutch gear mechanism 93 rotates in a reciprocating manner within the range of a predetermined rotation angle (about 330 degrees in the present example) with respect to the cylindrical cam 94. The cylindrical cam 94 rotates in a reciprocating manner within the range of a predetermined rotation angle (about 290 degrees in the present example) with respect to the side wall 51*e* of the housing 51. The cylindrical cam 94 has a cam surface formed on part of its circumference. The cylindrical cam 94 is engaged with the first lever support 67 of the swing lever 65 to pivot the first lever support 67 and maintain the first lever support 67 at a predetermined position.

The two-stage gear 90 functioning as the input gear has a greater diameter than the two-stage gear 91 in the next stage. When power is transmitted from the two-stage gear 90 to the two-stage gear 91, the power is amplified. The two-stage gear 90 includes a large-diameter gear portion 90*a* and a small-diameter gear portion 90*b*. The large-diameter gear portion 90*a* is engaged with the gear 48 of a gear train for the paper transporting system (paper feeding and discharging system) (refer to FIG. 4). The small-diameter gear portion 90*b* is engaged with the large-diameter gear portion 91*a* of the two-stage gear 91. Further, the small-diameter gear portion 91*b* of the two-stage gear 91 is engaged with the gear 95 of the friction clutch gear mechanism 93. The cylindrical cam 94 has a toothed portion 94*a* with partially missing teeth. The cylinder 96 has a toothed portion 96*a* with partially missing teeth. The small-diameter gear portion 91*b* of the two-stage gear 91 has a predetermined axial length, and is engaged with a toothed portion 95*a* of the gear 95, the toothed portion 96*a* of the cylinder 96, and the toothed portion 94*a* of the cylindrical cam 94.

As shown in FIG. 5, a cover 100 is attached to the housing 51 to cover the side wall 51*e* of the housing 51. The cover 100 is hooked to the housing 51. The cover 100 has three extensions 101. Engagement hooks 51*k* arranged to project from the upper surface and the bottom surface of the housing 51 are engaged with engagement holes 101*a* of the extensions 101. The coil spring 97 compressed between the gear 95 and the inner surface of the cover 100. Further, the distal portions of the two shafts 51*g* and 51*h* are inserted through shaft holes 100*a*, which are formed in the cover 100. The distal portion of the shaft 51*f* is inserted through a shaft hole (not shown) formed in the inner surface of the cover 100.

(Power Transmission Mechanism)

Figure 14:
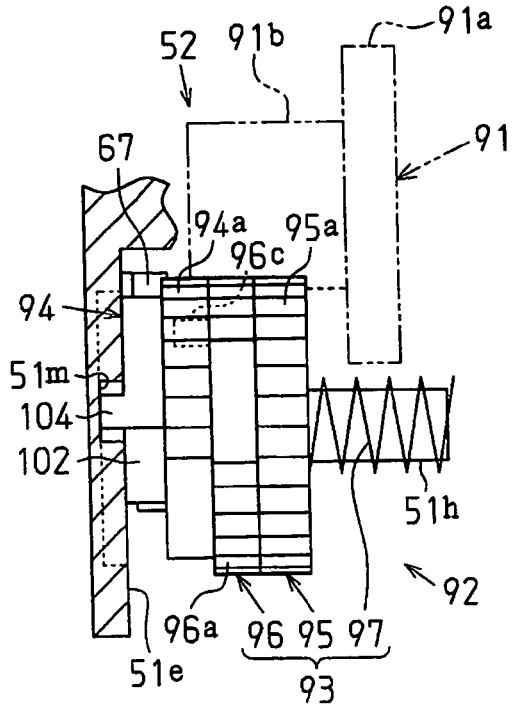
FIG. 14 is a schematic front view partially showing a power transmission mechanism shown in FIG. 5.

The clutch cam mechanism 92 in the power transmission mechanism 52 will now be described in detail. FIG. 14 is a front view of the clutch cam mechanism 92. As shown in FIG. 14, the cylindrical cam 94, the cylinder 96, the gear 95, and the coil spring 97 are fixed in the stated order to the shaft 51*h* of the clutch cam mechanism 92. The urging force of the coil spring 97 is applied to the contact surfaces of the gear 95 and the cylinder 96 so that the contact surfaces of the gear 95 and the cylinder 96 are in a frictional engagement. When the cylinder 96 is subjected to a load greater than the force produced by the fictional engagement of the contact surfaces (static friction force), the contact surfaces (clutch surfaces) slide relative to each other such that only the gear 95 rotates freely. When the cylinder 96 is subjected to a load less than or equal to the force of frictional engagement of the contact surfaces, the cylinder 96 and the gear 95, which are in frictional engagement, rotate integrally. The cylinder 96 has a projection 96*c* on its surface facing the cylindrical cam 94. The projection 96*c* is fitted in an arcuate groove 94*c* (refer to FIG. 15A), which is formed on the cylindrical cam 94. The cylinder 96 rotates relative to the cylindrical cam 94 within the range in which the projection 96*c* is movable in the arcuate groove 94*c*. The cylindrical cam 94 also has a projection 104 on its surface facing the side wall 51*e*. The projection 104 is fitted in an arcuate groove 51*m*, which is formed on the side wall 51*e*. The cylindrical cam 94 rotates relative to the side wall 51*e* within the range in which the projection 104 is movable in the arcuate groove 51*m* (e.g. in the range of 290 degrees). Further, the cylindrical cam 94 has a cam portion 102 and a toothed portion 94*a* that are arranged coaxially at positions close to each other. The first lever support 67 extends downward from an upper portion of the cam portion 102 along the surface of the side wall 51*e* and comes in contact with the circumferential surface (cam surface) of the cam portion 102.

Figure 15A:
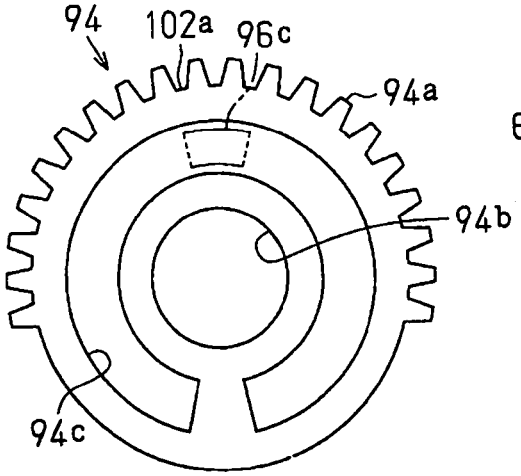
FIG. 15A is a schematic front view of a cylindrical cam shown in FIG. 5.
Figure 15B:
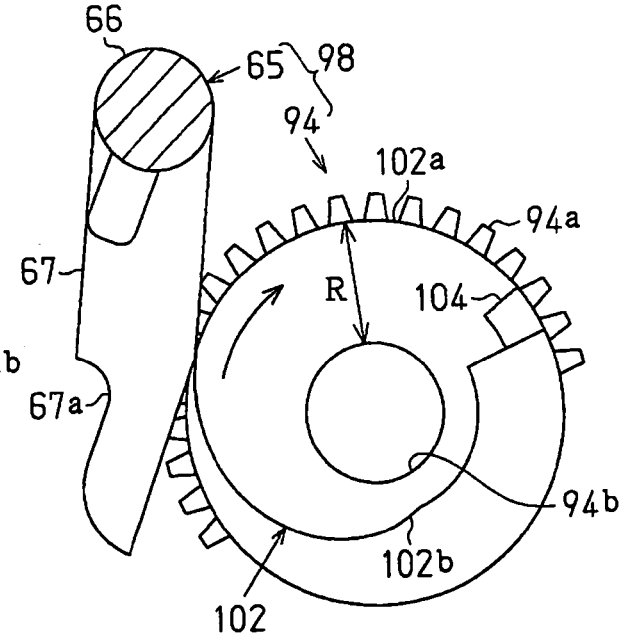
FIG. 15B is a schematic rear view of the cylindrical cam shown in FIG. 5.

FIG. 15 shows the cylindrical cam 94. FIG. 15A is a front view of the cylindrical cam 94 and FIG. 15B is a rear view of the cylindrical cam 94. FIG. 15B additionally shows the first lever support 67. As shown in FIG. 15A, the arcuate groove 94*c* having an arcuate shape is formed on the front surface of the cylindrical cam 94 to extend to surround the shaft hole 94*b* within the angular range of about 330 degrees. The projection 96*c* of the cylinder 96 is fitted in the arcuate groove 94*c* as indicated by the broken line in FIG. 15A. As a result, the cylinder 96 rotates in a reciprocating manner within the angular range of about 330 degrees with respect to the cylindrical cam 94 (finite rotation range). Further, the cylindrical cam 94 rotates in a reciprocating manner within the angular range of about 290 degrees (finite rotation range) in which the projection 104 is movable in the arcuate groove 51*m*.

As shown in FIG. 15B, the cam portion 102 is formed to surround the shaft hole 94*b* on the rear surface of the cylindrical cam 94. The cam portion 102 includes a first cam area 102*a* and a second cam area 102*b*. The first cam area 102*a* has a first radius R. The second cam area 102*b* is continuous to the first cam area 102*a* and has a radius gradually decreasing from the first radius R. A rear surface (right side surface in FIG. 13B) of the first lever support 67 first comes into contact with the first cam area 102*a* and then comes into contact with the second cam area 102*b* within the angular range of about 290 degrees in which the cylindrical cam 94 rotates in a reciprocating manner. The rear surface of the first lever support 67 forms a cam follower that is engaged with the cam portion 102. In the preferred embodiment, a conversion mechanism 98 includes the cylindrical cam 94 and the swing lever 65 as shown in FIG. 15B. The conversion mechanism 98 converts rotation (first output movement) of the cylindrical cam 94 to pivoting of the first lever support 67 (pivotal reciprocation) using the cam portion 102 of the cylindrical cam 94 and the cam follower of the swing lever 65 (rear surface of the first support lever 67). The conversion mechanism 98 further converts pivoting of the first lever support 67 to reciprocating linear movement of the magnetic member 55 (operation member).

When the first lever support 67 comes in contact with the first cam area 102*a*, the distal end of the first lever support 67 moves to the left as shown in FIG. 13B and is maintained at a tilted position. The magnetic member 55 is arranged at the closing position distanced from the magnetic force application surface 78 (refer to FIG. 16A). When the first lever support 67 comes in contact with the second cam area 102*b*, the distal end of the first lever support 67 pivots and moves gradually to the right as the cylindrical cam 94 in the state shown in FIG. 15B rotates in the direction indicated by the arrow (clockwise) so that the magnetic member 55 approaches the magnetic force application surface 78 and moves to the opening position (refer to FIG. 16B). When the cartridge is disconnected, the functional arm 87 of the valve opening lever 53 presses the abutment portion 68*b* of the second lever support 68 with the urging force applied by the coil spring 58. In this state, the swing lever 65 is constantly locked at the closing position irrespective of the rotated position of the cylindrical cam 94.

The toothed portion 94*a* formed on the outer circumference of the cylindrical cam 94 is engaged with the small-diameter toothed portion 91*b* of the two-stage gear 91 when the cylindrical cam 94 is within an intermediate range of its finite rotation range (in the range of a rotation angle of about 290 degrees) excluding the two end points (two edges).

Further, before the projection 96*c* moves from one end (starting point) to the other end (end point) of the arcuate groove 94*c*, the cylinder 96 rotates freely without its torque being transmitted to the cylindrical cam 94. The torque of the cylinder 96 is transmitted to the cylindrical cam 94 only after the projection 96*c* reaches the other end (end point) of the arcuate groove 94*c*. Thereafter, the cylindrical cam 94 rotates together with the cylinder 96. In this way, the projection 96*c* of the cylinder 96 and the arcuate groove 94*c* of the cylindrical cam 94 form a transmission delay mechanism for delaying transmission of the torque. In the preferred embodiment, the delay rotation amount of the transmission delay mechanism is set to correspond to about one rotation (about 330 degrees). The delay rotation amount may be set at an appropriate value less than 360 degrees. In this way, the cylinder 96 rotates in a reciprocating manner within the rotation range of about 620 degrees (hereafter referred to as the "finite rotation range of the cylinder 96"), which includes the delay rotation amount (about 330 degrees) and the finite rotation range (about 290 degrees) of the cylindrical cam 94.

Further, the toothed portion 96*a* of which teeth are partially missing, is formed on the circumferential surface of the cylinder 96. The toothed portion 96*a* is not engaged with the small-diameter toothed portion 91*b* of the two-stage gear 91 when the cylinder 96 moves to a rotation angle corresponding to a position close to the two end points of its finite rotation range (about 620 degrees). In other words, the toothed portion 96*a* is engaged with the small-diameter toothed portion 91*b* when the cylinder 96 rotates within the intermediate range excluding the two edges (two end points) of its finite rotation range. Thus, power is transmitted to the toothed portion 96*a* from the gear 95 via the friction-tied surfaces only within the range in which the cylinder 96 reciprocates in the finite rotation range. Further, the power is transmitted to the two-stage gear 91 by the engagement between the toothed portion 96*a* and the small-diameter toothed portion 91*b*. When the cylinder 96 reaches one of the two end points of its finite rotation range, the engagement between the toothed portion 96*a* and the small-diameter toothed portion 91*b* is disengaged, and the clutch surfaces slide along each other. As a result, the cylinder 96 stops at the end point, and only the gear 95 rotates freely.

The operation of the printer 10 and the valve device 50 will now be discussed.

As shown in FIG. 3, the valve opening lever 53 is at the projected position (locked position) shown by the broken line in FIG. 4 when the cartridge 30 is disconnected. In this state, the functional arm 87 of the valve opening lever 53 pushes the rear surface of the abutment portion 68*b* of the second lever support 68. Further, the swing lever 65 is arranged at the closing position shown in FIGS. 12A and 12B. The magnetic member 55 is at the closing position and distanced from the magnetic force application surface 78. Thus, the valves 76 are closed. In this way, when the cartridge 30 is disconnected, the swing lever 65 (pivot member) solely functions as a conversion mechanism, which converts the torque of the valve opening lever 53 produced by the urging force of the return coil spring 58 that moves the magnetic member 55 to the closing position. Further, the valve opening lever 53 and the return coil spring 58 function as the lock mechanism 54 for holding the magnetic member 55 at the closing position. The lock mechanism 54 locks the valves 76 in the closed state. In this case, ink leakage from the supply needles 23 of the holder 20 is prevented. For example, the valves 76 are not opened even when the electric motor 37 is driven in this state. More specifically, even when the cylindrical cam 94 rotates using the driving force of the electric motor 37, the lock mechanism 54 remains locked by the functional arm 87 pushing the abutment portion 68*b*. As a result, the swing lever 65 is forcibly locked at the closing position.

When the cartridge 30 is connected, the cartridge 30 pushes and pivots the valve opening lever 53. As a result, the valve opening lever 53 is moved from the projected position to the retracted position. As shown in FIGS. 13A and 13B, the functional arm 87 of the valve opening lever 53 is moved away from the abutment portion 68*b* of the second lever support 68 by a predetermined distance, so that the lock mechanism 54 is unlocked. In this state, the electric motor 37 may drive and open or close the valves 76. In this way, the swing lever 65 is maintained at the closing position and the valves 76 remain closed when the cartridge 30 is simply connected. When the cartridge 30 is connected, the supply needles 23 of the holder 20 are inserted in the support openings 33 for ink supply of the cartridge 30. In this state, ink may be supplied from the cartridge 30 to the holder 20.

In the printer 10 of the preferred embodiment, the valves 76 are basically controlled to be closed when printing is not performed. For example, even after the printer 10 is activated, the valves 76 remain closed when printing is not performed. When, for example, the printer 10 receives print data from a host computer and starts printing, the electric motor 37 is driven to produce a predetermined amount of forward rotation to open the valves 76. When the electric motor 37 is driven to rotate in the forward direction in the unlocked state of the lock mechanism 54, the cylindrical cam 94 rotates and the contact portion of the first lever support 67 shifts from the first cam area 102*a* to the second cam area 102*b*. As a result, the first lever support 67 pivots from the closing position shown in FIG. 16A to the opening position shown in FIG. 16B. In this way, the swing lever 65 is arranged at the opening position shown in FIG. 16B so that the magnetic member 55 is arranged at the opening position to open the valves 76.

During printing, the electric motor 37 produces forward rotation for paper setting, paper feeding, and paper discharging. The cylindrical cam 94 is at the valve opening position shown in FIG. 16B. In this state, even when the electric motor 37 is continuously driven to produce forward rotation, the gear 95 and the cylinder 96 slide along their contact surfaces that are in frictional engagement (clutch surfaces). The cylindrical cam 94 is held at the end point of its reciprocating rotation range. The cylindrical cam 94 does not further rotate clockwise from the state shown in FIG. 16B. In this manner, the first lever support 67 is maintained at the opening position and the valves 76 are maintained in the opened state during paper feeding and paper discharging.

For example, after the electric motor 37 is driven to rotate in the forward direction to feed a recording sheet, the electric motor 37 may be driven to rotate in the reverse direction to back-feed and set the recording paper to the print position. When the electric motor 37 is driven to start reverse rotation, the cylinder 96 and the cylindrical cam 94 are both at the end point of the reciprocating rotation range (rotation end point clockwise in FIG. 16). When the electric motor 37 is driven to start reverse rotation, the cylinder 96 first rotates freely by a predetermined rotation amount and then starts rotating together with the cylindrical cam 94. In other words, the rotation start timing of the cylindrical cam 94 is delayed.

During back-feeding, the rotation start timing of the cylindrical cam 94 is delayed so that the closing operation of the valve device 50 is not performed. More specifically, the reverse rotation drive amount of the electric motor 37 for back-feeding is less than or equal to an amount corresponding to the rotation amount of the cylinder 96 that includes the delayed rotation amount of the cylinder 96 and the rotation amount of the cylindrical cam 94 before the cam portion 102 starts moving the first lever support 67 from the closing position to the opening position. In this case, the closing operation of the valve device 50 is not performed. Afterwards, during printing, the electric motor 37 is driven to produce forward rotation for both paper feeding and paper discharging, and the valves 76 are maintained in the opened state.

When printing is suspended, the electric motor 37 is driven to produce reverse rotation and close the valves 76. When the electric motor 37 is driven to produce reverse rotation in this way, the cylindrical cam 94 starts rotating after the delay time generated by the transmission delay a mechanism described above elapses, and then the first lever support 67, which is engaged with the cam portion 102 of the cylindrical cam 94, rotates from the opening position to the closing position. As a result, the magnetic member 55 moves from the opening position to the closing position to close the valves 76.

In the process of rotating the cylinder 96 and the cylindrical cam 94, the toothed portions 96*a* and 94*a*, of which teeth are partially missing, are engaged with the small-diameter part 91*b* of the two-stage gear 91. In this state, the torque of the two-stage gear 91 is directly transmitted to the cylinder 96 by the engagement between the small-diameter toothed portion 91*b* and the toothed portion 96*a*. As a result, the cylinder 96 rotates in a reliable manner without sliding with respect to the gear 95 on the contact surfaces in frictional engagement even when, for example, oil is adhered to the contact surfaces of the gear 95 and the cylinder 96 and the contact surfaces easily slide relative to each other, or when ink is adhered to the contact surfaces of the gear 95 and the cylinder 96 and the transmission load at the contact surfaces is high. Further, the torque of the two-stage gear 91 is directly transmitted to the cylindrical cam 94 by the engagement between the small-diameter toothed portion 91*b* and the toothed portion 94*a*. As a result, the valves 76 open and close in a reliable manner.

In the valve device 50 of the preferred embodiment, the magnetic member 55 linearly moves in the direction perpendicular to the magnetic force application surface 78 when the valves 76 open and close. Rotation of the cylindrical cam 94 (output movement of the power transmission mechanism 52) is converted to linear movement of the magnetic member 55 by the cam portion 102 of the cylindrical cam 94 and the first lever support 67 forming the conversion mechanism 98.

When the valves 76 are open, the cylindrical cam 94 rotates clockwise in FIG. 16A. When the contact point of the first lever support 67 with the cylindrical cam 94 shifts from the first cam area 102*a* to the second cam area 102*b*, the first lever support 67 rotates substantially at a constant velocity from the closing position toward the opening position. As a result, the swing lever 65 rotates from the closing position to the opening position. The support arms 62 and 62 of the magnetic member 55, which are supported in the recesses 67*a* and 68*a* of the first and second lever supports 67 and 68 of the swing lever 65 are guided along the guide slots 63 and 63. The holder 61 is also guided along the inner wall surface (guide surface) of the square accommodation portion 51*a*. As a result, the magnetic member 55 moves linearly in the axial direction of the valves 76.

Attraction force constantly acts between the magnetic member 55 and the components of the valves 76 that are made of steel metal, such as the valve members 81. The attraction force is applied to the magnetic member 55 and causes the magnetic member 55 to move toward the valves 76. The magnetic member 55 moves toward the magnetic force application surface 78 to a position substantially in contact with the magnetic force application surface 78. In the process of moving the magnetic member 55, the attraction force of the magnetic member 55 applied to the valve members 81 increases gradually as the magnetic member 55 moves closer to the valve members 81. When the attraction force of the magnet 59 exceeds the urging force of the spring 82, the valve members 81 move toward the magnetic member 55 so that the valves 76 open. When the valves 76 are open, ink contained in the cartridge 30 may be supplied to the carriage 12 via the passages 75 and the supply passages 18 connected to the discharge tubes 25 in the holder 20. The closing operation of the valves 76 is reversed to that of the opening operation of the valves 76. In the closing operation of the valves 76, the magnetic member 55 moves in a direction in which the magnetic member 55 moves away from the magnetic force application surface 78 linearly in the axis direction of the valves 76.

In the preferred embodiment, the magnetic member 55 includes the single magnet 59. The magnet 59 is constantly positioned at a uniform distance from each of the valve members 81 when the magnetic member 55 is close to or distanced from the magnetic force application surface 78. This enables the valves 76 to open and close at substantially the same timings. In the conventional swing-type valve mechanism, the magnet moves toward the magnetic force application surface in a direction parallel to the magnetic force application surface. To open and close all the valves at substantially the same timing, the conventional valve mechanism requires one magnet for each valve. However, the valve device 50 of the preferred embodiment uses the single magnet 59 to enable all the valves 76 to open and close at the same opening and closing timings.

Figure 11:
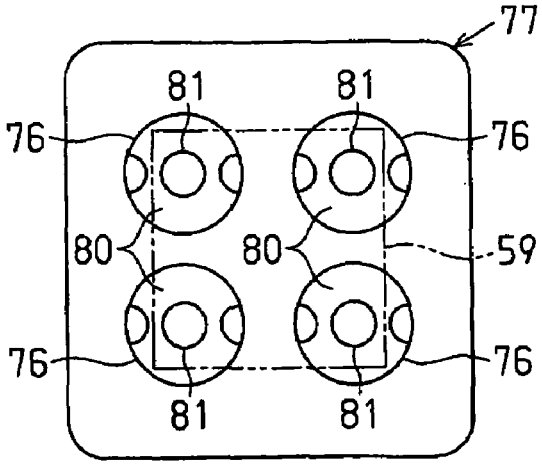
FIG. 11 is a schematic perspective front view of a valve arrangement unit included in a holder shown in FIG. 3.

FIG. 11 shows the valve arrangement unit 77 of the holder 20 shown in FIG. 3. FIG. 11 is a perspective view in which the surface layer (film etc.) of the holder 20 is removed to show the components (including the valve members 81) of the valves 76. As shown in the drawing, the interval of the valves 76 is narrower than the interval of the valves 120 required by the swing member 124 used in the conventional swing-type valve mechanism of FIG. 1. The valves 76 are arranged densely at narrow intervals. The valve arrangement unit 77 may thus be downsized. As a result, the surface area of the magnet 59 may be small and the magnet 59 may be downsized. Accordingly, the magnetic member 55 may be miniaturized.

The valves 76 can be arranged at narrow intervals for the reasons described below. In the conventional swing-type valve device, the magnets are moved along the magnetic force application surface. This requires the valves to be arranged at relatively large intervals in a manner that the magnets are positioned so as not to attract the valve members of the adjacent valves when the valves are closed. As a result, the valve arrangement unit 121 (refer to FIG. 1) is relatively large. However, in the valve device 50 of the preferred embodiment, the magnet 59 moves linearly in the direction perpendicular to the magnetic force application surface 78. Unlike the conventional swing-type valve device, the valve device 50 eliminates the need for arranging the valves at large intervals to prevent the magnet from affecting the valve members of the adjacent valves. This enables the valve device 50 to decrease the valve interval to the minimum value permitted in design and enables the valves 76 to be densely arranged at narrow intervals as shown in FIG. 11.

Further, the yoke 60 is formed to surround the rear surface and the side surfaces of the magnet 59 in the preferred embodiment. More specifically, the peripheral parts of the yoke 60 are formed into the projections 60*a* projecting toward the front surface of the magnet 59 in a manner so as to surround the periphery of the magnet 59. This enables the magnetic force to concentrate on the front surface of the magnet 59. The magnetic force is strengthened at positions close to the magnet 59 and weakened at positions distant from the magnet 59. As a result, as the magnetic member 55 is moved from a position distant from the magnetic force application surface 78 (closing position) toward the magnetic force application surface 78, when the force attracting the valve members 81 using the magnetic force exceeds the urging force of the spring 82, the valves 76 are open. This enables a relatively small movement amount of the magnetic member 55 to open and close the valves 76. As a result, the movement stroke amount of the magnetic member 55 may be set to be relatively short and a small magnet may be used as the magnet 59 to apply a strong magnetic force to the valve members 81. This enables the magnet 59 (magnetic member 55) to be further downsized (thinned).

As described above, the magnetic member 55 is downsized and the movement amount of the magnet 55 is reduced. This enables the guide structure of the magnetic member 55 (the accommodation portion 51*a* and the guide slots 63) to be incorporated in the housing 51. In the preferred embodiment, part of the housing 51 is formed as the square accommodation portion 51*a* for guiding movement of the magnetic member 55, and the guide slots 63 for guiding the two support arms 62 are formed in the side wall of the accommodation portion 51*a*. In the conventional swing-type valve device (refer to FIG. 1), the magnets must be moved by a larger movement amount due to the reasons described above. This requires the arm 124*b* of the swing member 124 to be elongated or the range of a pivot angle of the swing member 124 to be increased. When the arm 124*b* of the swing member 124 is elongated, the valve mechanism has a larger dimension in its height direction. When the range of the pivot angle of the swing member 124 is increased, the swing member 124 occupies a wider space for its movement. In comparison, as described above, the valve device 50 of the preferred embodiment requires only a space in which the magnet 55 slides. Such a space corresponds to the volume of a rectangular solid having a cross-sectional area corresponding to the size of the magnetic member 55 and having a length obtained by adding the thickness of the magnetic member 55 and the movement amount of the magnetic member 55. The valve device 50 requires a relatively small space in which the swing lever 65 functioning as a linear movement conversion component is arranged. Thus, the valve device 50 has a smaller dimension in its height direction than the conventional valve device having the long arm 124*b* of the swing member 124. Further, the valve device 50 requires a smaller operation space than the conventional valve device having the swing member 124 pivoted within the large pivot angle range. As a result, the valve device 50 occupies a smaller space.

The printer 10 including the valve device 50 of the preferred embodiment has the advantages described below.

The magnetic member 55 is moved away from the magnetic force application surface 78 in the direction perpendicular to the magnetic force application surface 78 to close the valves 76. The magnet 59 at the closing position is inevitably moved away from its adjacent valve members 81. In the valve mechanism included in the conventional valve device, the magnets located close to the magnetic force application surface move in the planar direction (direction perpendicular to the movement direction of the valve members). Thus, the conventional valve device requires its valves to be arranged at relatively large intervals in a manner that the magnets are positioned so as not to attract their adjacent valve members when the valves are closed. However, in the valve device 50 of the preferred embodiment, the magnetic member 55 moves away from all the valves 76 when the magnetic member 55 moves from the opening position toward the closing position. Thus, the valve device 50 of the preferred embodiment eliminates the need for arranging the valves at large intervals. This enables the valve device 50 to set the interval of the valves 76 to a minimum value and enables the valves 76 to be arranged densely. As a result, the valve arrangement unit 77 may be downsized. Accordingly, the holder 10 may be downsized.

The magnet 59 of the magnetic member 55 is arranged in a relatively small area corresponding to the densely arranged area of the valve members 81. As a result, the magnetic member 55 is downsized. Accordingly, the valve device 50 is downsized.

The valve device 50 has a smaller movement stroke amount than the conventional swing-type valve mechanism. This enables the valve device 50 to be downsized. The magnetic member 55 moves in the direction perpendicular to the magnetic force application surface 78. Thus, the movement stroke amount of the magnetic member 55 required to open and close the valves 76 is smaller as compared with when the magnet is moved in a direction diagonal to the magnetic force application surface 78. As a result, the valve device 50 is further downsized.

The magnetic member 55 moves in the direction perpendicular to the magnetic force application surface 78. This enables the single magnet 59 to be used irrespective of the number of the valves 76 (the number of the valve members 81). In this case, the magnetic member 55 is downsized and the cost of the magnetic member 55 is reduced.

The magnetic member 55 moves linearly. Thus, when the magnetic member 55 moves toward or away from the valves 76, the magnetic member 55 is positioned substantially at a uniform distance from each of the valve members 81 irrespective of the movement position of the magnetic member 55. This reduces variations in the timings at which the valves 76 open and close using the magnetic member 55. In the conventional valve device in which the magnetic member pivots, the angle of the magnetic member changes depending on its position on the curved pivoting path. In this case, the opening and closing timings of the passages vary easily. However, the valve device 50 of the preferred embodiment minimizes such variations in the opening and closing timings of the valves 76, and the valves 76 open and close substantially at the same timings.

The yoke 60 has the projections 60*a*, which cover the rear surface of the magnet 59 and project toward the front surface of the magnet 59. The yoke 60 concentrates the magnetic force at the front surface of the magnet 59 and enables the magnetic force to be strengthened at positions closer to the magnet 59 and weakened at positions distant from the magnet 59. As a result, the movement stroke amount of the magnetic member 55 required to open and close the valves 76 is further reduced. This enables the valve device 50 to be further downsized.

The magnetic member 55 moves linearly. This eliminates the need for the long arm 124*b* or the swing member 124 occupying a large operation space, which are required in the conventional swing-type valve device. The linear sliding structure (the accommodation portion 51*a* and the guide slots 63) is formed to be compact. As a result, the valve device 50 has smaller dimensions in its height direction and its lateral direction.

It should be apparent to those skilled in the art that the present invention may be embodied in many other specific forms without departing from the spirit or scope of the invention. Particularly, it should be understood that the present invention may be embodied in the following forms.

(Modification 1) The conversion mechanism 98 for converting rotation of the cylindrical cam 94 (output movement of the power transmission mechanism 52) to linear movement of the magnetic member 55 (operation member) should not be limited to the cam lever mechanism that is formed by the cylindrical cam 94 and the first lever support 67 engaged with the cam portion 102 of the cylindrical cam 94. The conversion mechanism of the present invention may, for example, be formed by a cylindrical cam, which functions as a cam member, having a cam groove and a pin fitted in the cam groove and fixed to the operation member. In this case, the pin fitted in the cam groove reciprocates on the linear path and the operation member linearly reciprocates when the cylindrical cam rotates in a reciprocating manner. Instead of the operation member, the pin may be fixed to other members, such as a member for supporting the operation member or a member for pressing the operation member, and the linear movement using the pin may be transmitted indirectly to the operation member.

(Modification 2) The direction in which the magnetic member 55 moves linearly should not be limited to a direction perpendicular to the magnetic force application surface 78. For example, the magnetic member may move linearly in a direction at a predetermined angle θ (where $0° < \theta < 90°$) with respect to the magnetic force application surface 78. In this case, it is preferable that the movement direction of the magnetic member have a component representing magnitude of a vector in the movement direction of the valve members greater than an component representing magnitude of a vector in a direction perpendicular to the movement direction of the valve members. In other words, it is preferable that the predetermined angle θ be greater than 45 degrees. As a result, the movement stroke of the magnetic member between the opening position and the closing position is reduced and the magnet is prevented from attracting its adjacent valve members. In this case, the valve device 50 is further downsized.

(Modification 3) Movement of the magnetic member 55 should not be limited to linear movement and may be pivoted. More specifically, when the magnetic member pivots away from or toward the magnetic force application surface in the direction having an component that is in the movement direction of the valve members, the need for arranging the valves in large intervals is eliminated. In this case, the valve arrangement unit is downsized. Further, when the distance between the magnet at the closing position and the magnetic force application surface is large enough to prevent the magnet from attracting its adjacent valve members, the movement stroke of the magnetic member 55 or the component in the movement direction of the valve members in the moving process of the magnetic member 55 may be set in an appropriate manner. However, it is preferable that the component in the movement direction of the valve members be greater than the component in the direction perpendicular to the movement direction of the valve members. Further, it is preferable that the axial direction of the rotation axis of the swing member be perpendicular to the movement direction of the valve members. In this case, the magnetic member rotates toward or away from the valves in the movement direction of the valve members. In this case, the magnetic member is only required to include a single magnet for a plurality of valves. This enables the valves to be arranged at narrow intervals.

(Modification 4) The magnetic member may have as many magnets as the valves.

(Modification 5) The operation member should not be limited to a magnetic member formed by the magnet and the yoke. For example, the operation member may be formed only by the magnet.

(Modification 6) The opening and closing operation of the valves 76 by the valve device 50 does not have to be performed using power supplied from the rotation drive source and may be performed simply in cooperation with the connection and disconnection of the cartridge 30.

(Modification 7) The opening and closing operation of the valves 76 with the valve device 50 does not have to be performed with the valve opening lever 53 and may be performed using only power supplied from the rotation drive source.

(Modification 8) The liquid containing member should not be limited to the ink cartridge containing a liquid in advance before use for supplying the liquid to the liquid ejection apparatus. For example, the liquid containing member may be a cartridge that does not contain a liquid in advance before use and is used to collect a liquid from the liquid ejection apparatus. As one example of the liquid to be collected, the cartridge may be used to collect waste ink. The liquid containing member may be a cartridge dedicated to collection of the waste liquid. The liquid to be collected should not be limited to the waste liquid. When the liquid is circulated and used repeatedly, the liquid containing member may be used to collect only usable parts of the liquid. When such a liquid containing member is used, the liquid to be collected is prevented from leaking from the cartridge holder (connected part). Further, the liquid supply apparatus should not be limited to the apparatus for supplying a liquid to the liquid ejection head. For example, the liquid supply apparatus may be an apparatus for supplying a liquid such as a cleaning liquid or a lubricating liquid.

(Modification 9) The valves may be butterfly valves, flap valves, cone valves, ball valves, or needle valves. When the valves include valve members having arcuate paths in the closing and opening operation of the valves, the movement direction of the valve members of the valves is the direction in which the valve members are attracted by the magnet.

(Modification 10) The liquid ejection apparatus including the valve device should not be limited to the inkjet printer 10 and may be an apparatus for ejecting a liquid other than ink (including a liquid in which particles of a functional material are dispersed). For example, the liquid ejection apparatus may be an apparatus for ejecting a liquid in which an electrode material or a color material for use in manufacturing a liquid crystal display, an EL (electroluminescence) display, or a surface emitting display, is dispersed or dissolved, or an apparatus for ejecting living organisms for use in manufacturing a biochip, or an apparatus used as a precision pipette for ejecting a sample of liquid. The valve device is applicable to any one of such liquid ejection apparatuses.

The present examples and embodiments are to be considered as illustrative and not restrictive, and the invention is not to be limited to the details given herein, but may be modified within the scope and equivalence of the appended claims.

What is claimed is:

1. A liquid ejection apparatus for use with a liquid, the liquid ejection apparatus comprising:

an accommodation portion for accommodating a liquid containing member;

a connected part to which the liquid containing member is connected, the connected part being arranged in the accommodation portion;

a valve device, arranged on the connected part, for opening and closing a valve including a movable valve member;

an operation member movable toward and away from the valve, the operation member moving the valve member with magnetic force when moving toward or away from the valve to open or close the valve;

a first power transmission mechanism for transmitting power from a rotation drive source;

a second power transmission mechanism for restricting a movement of the operation member in a direction for opening the valve when the liquid containing member is disconnected from the connected part; and a conversion mechanism for converting each of the power transmitted from the first power transmission mechanism and the power transmitted from the second power transmission mechanism to movement of the operation member in the movement direction of the operation member, wherein:

the operation member is formed to move in a movement direction of the valve member; and when the power from the rotation drive source is transmitted to the operation member via the first power transmission mechanism in a state in which the restriction of the movement of the operation member in the direction for opening the valve is eliminated by connection of the liquid containing member to the connected part, the operation member moves in the direction for opening the valve and thereby opens the valve.

2. The liquid ejection apparatus according to claim 1, wherein there are a plurality of valves, and the operation member includes a single magnet, and the single magnet opens and closes the plurality of valves.

3. The liquid ejection apparatus according to claim 1, wherein the second power transmission mechanism includes:

a movable member that moves between a first position and a second position, wherein the movable member is pressed by the liquid containing member and held at the first position when the liquid containing member is connected to the liquid ejection apparatus; and an urging member for urging the movable member from the first position to the second position, wherein the urging member holds the movable member at the second position when the liquid containing member is disconnected from the liquid ejection apparatus; and wherein when the movable member moves from the first position to the second position, urging force of the urging member is transmitted to the operation member via the conversion mechanism to close the valve.

4. The liquid ejection apparatus according to claim 3, wherein:

the conversion mechanism includes a pivot member engagable with both of the first power transmission mechanism and the second power transmission mechanism and pivotal in a reciprocating manner in accordance with the direction of the power transmitted from the first power transmission mechanism;

when the liquid containing member is disconnected from the liquid ejection apparatus, the pivot member is pivoted in a direction in which the pivot member closes the valve by power transmitted from the movable member, and pivoting of the pivot member in a direction in which the pivot member opens the valve is restricted by urging force of the urging member; and when the liquid containing member is connected to the liquid ejection apparatus, the movable member moves against the urging force of the urging member and eliminates the restriction on the pivoting of the pivot member in the direction in which the pivot member opens the valve.

5. The liquid ejection apparatus according to claim 4, wherein the second power transmission mechanism includes a lock mechanism restricting pivoting of the pivot member when the liquid containing member is disconnected from the liquid ejection apparatus and eliminating the restriction on the pivoting of the pivot member when the liquid containing member is connected to the liquid ejection apparatus.

6. The liquid ejection apparatus according to claim 5, wherein the pivot member includes:

a first engagement portion engaged with the operation member and the first power transmission mechanism; and a second engagement portion engaged with the operation member and the lock mechanism; and wherein the lock mechanism comes in contact with the second engagement portion to restrict pivoting of the pivot member when the liquid containing member is disconnected from the liquid containing member, and the lock mechanism is separated from the second engagement portion to eliminate the restriction on pivoting of the pivot member when the liquid containing member is connected to the liquid ejection apparatus.

7. The liquid ejection apparatus according to claim 1, wherein:

the first power transmission mechanism includes a cam member rotated in a reciprocating manner about a predetermined axis; and the conversion mechanism includes a cam portion located on the cam member and a cam follower engaged with the cam portion.

* * * * *